US005173683A

United States Patent [19]

Brighenti et al.

[11] Patent Number: 5,173,683

[45] Date of Patent: Dec. 22, 1992

[54] APPARATUS AND METHOD FOR MULTIPLEXING MULTIPLE DATA AND ANALOG VALUES IN A PERIPHERAL DEVICE

[75] Inventors: Donald D. Brighenti; Charles J. Motyka, Jr., both of Westminster; Lawrence G. Stanley, Templeton, all of Mass.

[73] Assignee: Simplex Time Recorder Co., Gardner, Mass.

[21] Appl. No.: 689,401

[22] Filed: Apr. 22, 1991

[51] Int. Cl.[5] ..... G08B 26/00

[52] U.S. Cl. ..... 340/505; 340/514; 340/518; 340/588

[58] Field of Search ..... 340/505, 511, 514, 518, 340/588, 589, 825.06, 825.07, 825.08

[56] References Cited

U.S. PATENT DOCUMENTS

| | | | |
|---|---|---|---|
| 4,618,853 | 10/1986 | Yuchi | 340/514 |
| 4,658,243 | 4/1987 | Kimura et al. | 340/505 |
| 4,692,750 | 9/1987 | Murakami et al. | 340/514 |
| 4,725,819 | 2/1988 | Sasaki et al. | 340/511 |
| 4,796,025 | 1/1989 | Farley et al. | 340/825.08 |
| 4,916,432 | 4/1990 | Tice et al. | 340/505 |
| 4,988,977 | 1/1991 | Payne et al. | 340/514 |

OTHER PUBLICATIONS

Fenwalnet 4000 TM (Dec. 1988) "The Smartest Fire Alarm System".

*Primary Examiner*—Donnie L. Crosland

*Attorney, Agent, or Firm*—Panitch Schwarze Jacobs & Nadel

[57] ABSTRACT

A method and apparatus multiplexing multiple alarm and head type values in a peripheral fire alarm device includes a head component for sensing the presence or absence of smoke or heat and a base component for communicating with the control panel. A communication interface between the base and head components with no more than three connectors for multiplexing the values between the head component and the base component. The control panel stores algorithms particular to each type of head which may be used to determine if an alarm condition exists. Using data received from the peripheral fire alarm device, the control determines which type of head component is currently installed at the base component and selects the correct algorithm.

10 Claims, 5 Drawing Sheets

APPARATUS AND METHOD FOR MULTIPLEXING MULTIPLE DATA AND ANALOG VALUES IN A PERIPHERAL DEVICE

FIELD OF THE INVENTION

The present invention is generally related to multiplexing alarm and type of sensor values in a peripheral alarm detection device. This invention also relates to a method and apparatus which enables a control panel to adjust to changes in the type of peripheral alarm detection device.

BACKGROUND OF THE INVENTION

Conventional peripheral alarm detection devices used in the detection of smoke or fire have a head component for sensing the presence or absence of smoke or fire, and a base component in electrical communication with both the head component and a central control panel. The head component generates an analog value representative of an alarm condition. The value is outputted to the base component. The base component converts the analog signal to a digital one, and sends the converted signal to the control panel. The control panel, using a predetermined algorithm inserts the received signals into an algorithm and then evaluates whether an alarm condition exists and acts on it.

Generally, the head component in a peripheral smoke or fire detection device is a smoke sensor or heat detector. Conventional smoke and heat detectors are categorized as ionization, photo-optical and heat sensors. Usually, these sensors comprise sampling chambers in which an ambient condition is converted to a direct current voltage. Typically, the head component in fire detection systems becomes dirty with age and exposure to combustion products, dust and other film-forming contaminants. When a head component becomes dirty, the sensitivity of the head component is jeopardized and the level of protection provided is lessened. Thus, the head component must be removed and cleaned where possible, or replaced if defective.

Ionization, photo-optical and heat sensors have unique operating and analog output characteristics requiring different algorithms or values to be inserted into an algorithm to correctly evaluate the output of the sensors. For example, addressable interface Model No. 4100-8301 manufactured by Simplex Time Recorder Co. is a control panel in which a moving average of each peripheral fire detection device's output is maintained by the control panel. In such a control panel an alarm condition is determined by comparing the current value of the output of a peripheral fire detection device to the average value maintained by the control panel. Because each type of head component has a different analog value output, each produces a different average value. Accordingly, it is imperative that the control panel recognize the particular type of head component installed at the peripheral device so the correct average associated with the head component is applied to determine the presence or absence of an alarm condition.

In conventional addressable fire detection systems, the address representing the location of a given peripheral device is a predetermined digital value stored within the head component. Therefore, if a head component is removed from a base component at a first location and reinstalled into a base component at a second location, the address received by the control panel remains the same even though the location of the head component has changed.

In addition, in conventional alarm systems moving a head component of one type to a second location, where a different type of head component is desired, becomes problematic. For example, if a heat sensor is installed at a location where smoke is likely to be the predominant sign of a fire, such as a smoldering fire, safety could be compromised, because a photo-optical sensor is better suited for such a location. In an exchangeable head system, if the control panel cannot determine what type of sensor is installed at a particular location, the control panel may apply an incorrect algorithm or values to the data received from the peripheral device, resulting in false, missed or delayed alarms.

In the past, it has been necessary to provide as many as seven connection ports or pins between the head and base components to provide adequate means for communicating data and analog values between the head and base components. If the head component of a peripheral device can be one of several different types, it is necessary that each type of head component (typically three types) have its own connection port or pin. Then, there is one connection port or pin over which a sample command is communicated, two connection pins or ports over which the information corresponding to the sample is sent back to the base component and two power connection ports or pins, for a total of seven connection ports or pins.

In view of the deficiencies and inefficiencies of the prior art, it is desirable to have a simplified peripheral fire detection system with improved reliability having peripheral devices which communicate with a control panel to indicate when and what type of head component is connected to the base. It is also desirable to indicate if the type of head installed at a particular location has been changed to avoid improper processing.

SUMMARY OF THE INVENTION

The present invention relates to an apparatus for multiplexing data and analog values in a remote peripheral fire alarm detection device in communication with a control panel. Included in the apparatus is a head component comprising means for sensing fire by the presence of smoke or heat. The head component is removably secured to a base component which comprises means for communicating with the control panel and for controlling the head component according to commands received from the control panel. The invention further includes a communication interface for multiplexing type of sensor and alarm values between the head component and the base component which comprises no more than three connectors.

The present invention further includes a method and apparatus for communicating in an alarm detection system between a central control panel and at least one fire alarm detection device which comprises a base component and a removable head component. The method comprises: commanding the head component from the control panel to output data to the base component indicating the type of head component currently installed in the base component; outputting analog data from the head component to the base component indicating the type of head component currently installed at the base component; converting the analog data from the head component to digital data; and sending the digital data from the base component to the control panel, which processes the digital data received from the base component.

The present invention also includes a method and apparatus for communicating in an alarm detection system having a central control panel and at least one fire alarm detection device which comprises a base component and a removable head component, the method comprising: receiving at the base component a command from the control panel to command the head component to test the ambient condition of the air proximal the head component; responsively commanding the head component to test the ambient condition of the air proximal the head component; sending analog data from the head component to the base component indicating the ambient condition of the air proximal the head component; receiving analog data at the base component indicating the ambient condition of the air proximal the head component; converting the analog data received from the head component into digital data; and sending the digital data from the base component to the control panel, which processes the digital data received.

The present invention also includes a method for regularly adjusting an alarm detection system having a control panel and at least one fire alarm detection device comprising a head component and base component, wherein the head component may be one of several types and may be removed from the base component. Each type of head component is associated with a unique predetermined algorithm within the control panel. The algorithm is used to determine if an alarm condition exists by processing data received from the peripheral fire alarm detection device. The method comprises the steps of: sending a first digital message from the control panel to the base component requesting the current status of the head component; receiving at the control panel a second digital message from the base component which indicates a normal or abnormal status of the head component; sending a third digital message from the control panel to the base component instructing the base component to indicate the type of head component when an abnormal status is indicated by the second digital message; receiving at the control panel a fourth digital message from the base component which indicates the type of head component; sending a fifth digital from the control panel to the base component identifying to the base component the type of head component installed as the peripheral detection device; comparing the instructions sent to the base component with the fifth digital message to a type of head component information contained within the control panel; and adjusting a predetermined algorithm to correspond to the type of head component sent in the fifth digital message if the type of head component indicated in the fifth digital message is different than the type of head component information stored within the control panel.

BRIEF DESCRIPTION OF THE DRAWINGS

The foregoing summary of the invention, as well as the following detailed description of the preferred embodiments, will be better understood when read in conjunction with the appended drawings. For the purpose of illustrating the invention, there is shown in the drawings embodiments which are presently preferred, it being understood, however, that the invention is not limited to the specific arrangements and instrumentalities disclosed. In the drawings.

DESCRIPTION OF THE PREFERRED EMBODIMENT

Figure 2:
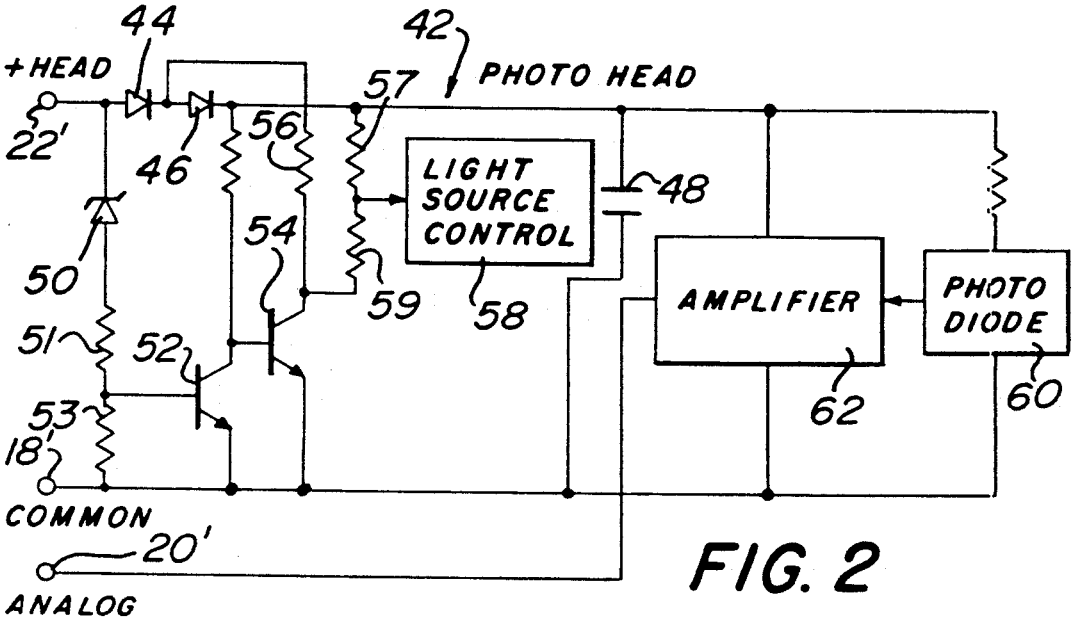
FIG. 2 is a schematic block illustration of a preferred photo-optical sensor for a head component of an alarm peripheral device in accordance with the present invention.
Figure 3:
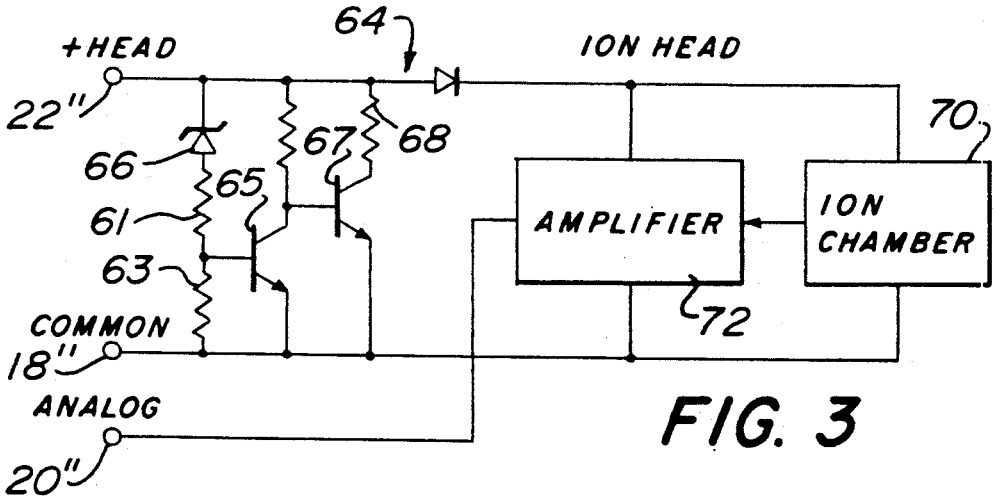
FIG. 3 is a schematic block illustration of a preferred ionization sensor for a head component of an alarm peripheral device in accordance with the present invention.
Figure 4:
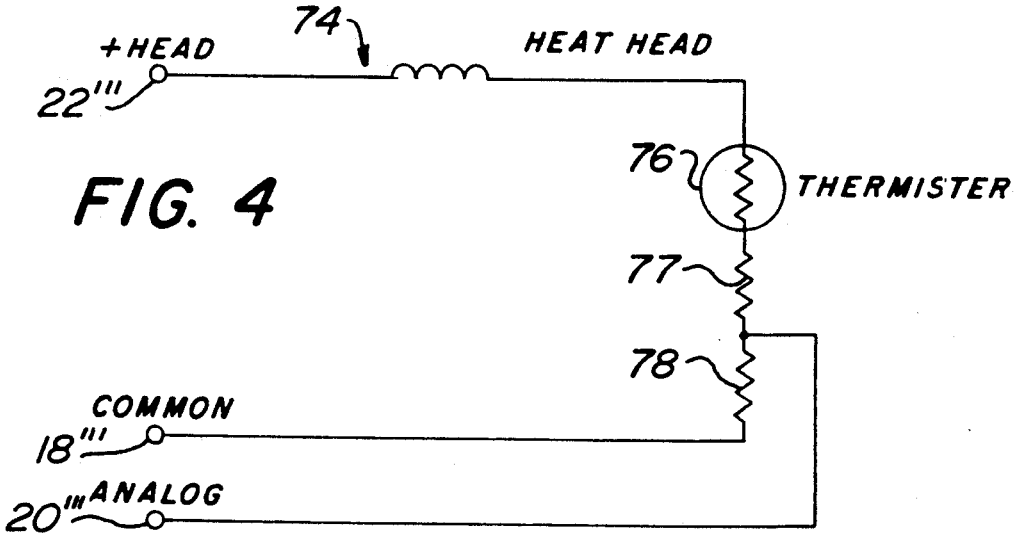
FIG. 4 is a schematic block illustration of a preferred heat sensor for a head component of an alarm peripheral device in accordance with the present invention.

Referring to the drawings, wherein like numerals indicate like elements throughout, there is shown in FIGS. 1–4 the basic operating components of a fire detection peripheral device. The physical structure of the device is not shown since it is conventional. The fire detection peripheral device comprises a head component (one of FIGS. 2–4) and a base component 10 (FIG. 1) operatively connected to each other and to a central control panel 12. Generally, the head component is a sensor or detector for sensing the presence or absence of smoke or heat in the vicinity of the head component. The head component can be one of three types: a photo-optical sensor device (FIG. 2), an ionization sensor device (FIG. 3),or a heat sensor device (FIG. 4). The principles of this invention may, however, be applied to other types of head components as they become known.

Figure 1:
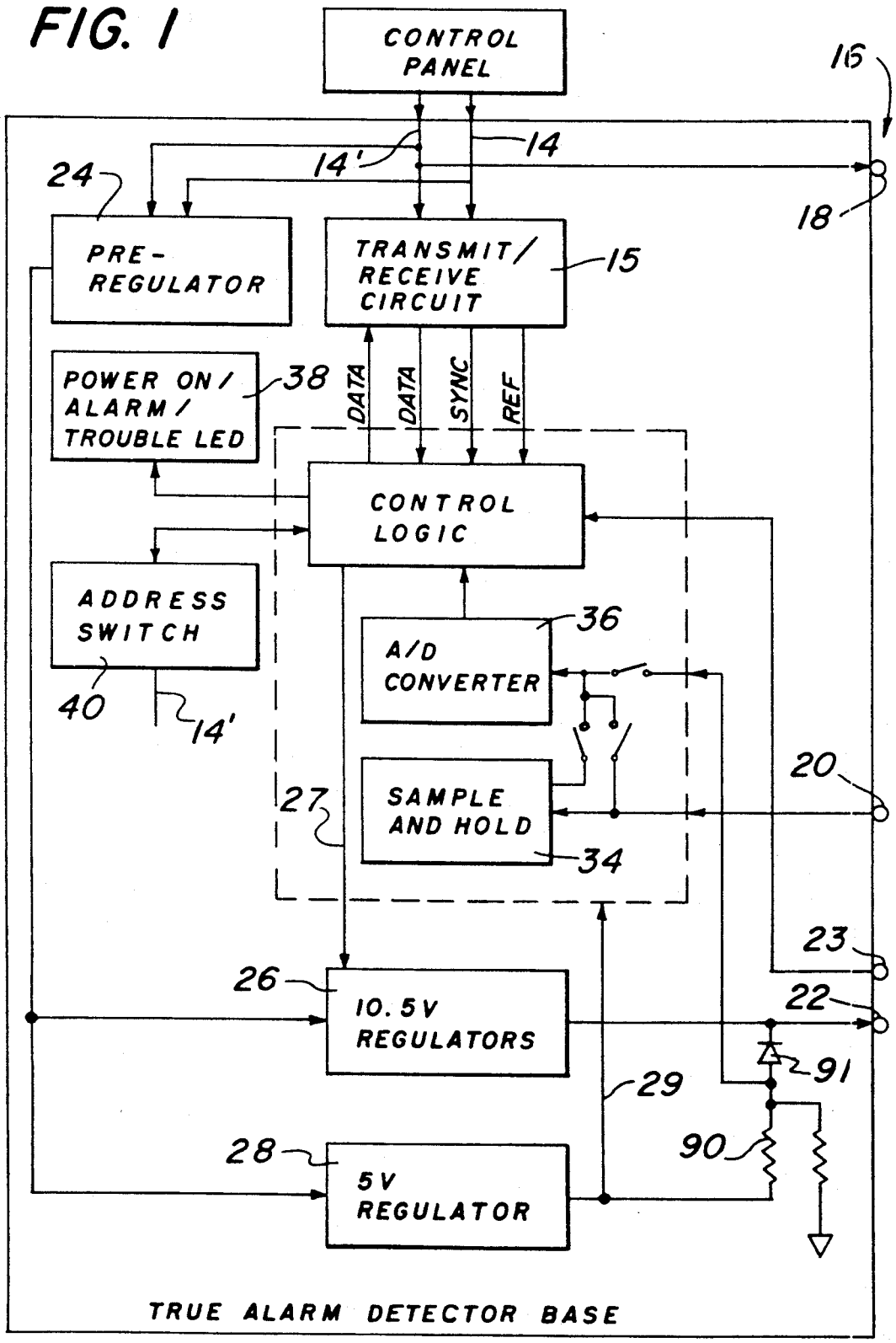
FIG. 1 is a schematic block illustration of a base component of an alarm peripheral device in accordance with the present invention.

Referring specifically to FIG. 1, there is shown a schematic block diagram of the base component 10 of a peripheral device. In the preferred embodiment, the physical structure of base component 10 is preferably a Model 4098-9781 base available from Simplex Time Recorder Co. The base component 10 is connected to the remote control panel 12 via communication lines 14, 14' such that the base component 10 can achieve bidirectional communication with the control panel. Communication lines 14, 14' also provide power to the base component 10 from the control panel 12. Communication line 14' acts as a circuit common.

The information exchanged between the control panel 12 and the base component 10 passes through a transmit/receive circuit 15. The transmit/receive circuit includes a series of voltage dividers which distribute the incoming and outgoing data from the control panel 12 and the data to and from communication control integrated circuit (IC) 30. Preferably, data is transmitted over the communication lines 14, 14' and received by the base component at approximately 3333 baud. The communication line 14 provides positive dc voltage to the base component 10 via voltage preregulator 24. The power source is preferably, but not necessarily, a 36 volt power source. The preregulator 24 sets the voltage of the base component 10 at approximately 14.5 volts. However, it is to be understood by those skilled in the art that the preregulator 24 could set the voltage to any desired preselected value consistent with the functional operation of the circuitry described herein.

The output of preregulator 24 powers a voltage regulator 26 which supplies a 10.5 dc voltage to the head component. Preregulator 24 also powers a 5 volt regulator 28 which acts both as the power supply to communication control IC 30 located within the base component 10 via line 29 and as a supplemental power source to the head component.

Communication control IC 30 is preferably a custom chip but may be discrete elements. In either case it functions in the same way for purposes of this invention, and includes control logic 32, which may be a microprocessor. The communication control IC 30 also includes an analog to digital (A/D) converter 36 and a sample and hold circuit 34.

The base component 10 performs three major functions. The first function is to physically secure the head component to the base component 10 by any conventional means. The second function is to control and receive sample voltage signals from the head component. The third function is to communicate type and alarm condition data received from the head component to the control panel 12.

The head component is connected to the base component 10 via a communication interface 16, which preferably comprises three pin connections 18, 20, and 22. The communication interface 16 acts to multiplex the analog signals transmitted between the head component and the base component 10. As a result, fewer pin connections are required to receive the necessary data. A reduction in pin connection serves to improve the reliability of the peripheral sensor as well as to decrease the cost of the sensor.

Pin connection 18 is a circuit common or signal ground connection between the head component and the base component 10. Pin connection 20 receives incoming analog signals from the head component. The analog signals are preferably voltage and/or current signals which indicate the type of head component located at that particular location as well as provide a reading as to the current status of the sensor. Pin connection 22 provides power to the head component and acts to transmit type of head command signal from the base to the head component. The command signal originates in the control panel 12. Interlock 23 is an optional communication interlock which acts to notify the control panel 12 of an error condition as is described hereinafter.

Analog data from the head component is sampled and transmitted via pin 20 to the base component 10 and is received by the communication control IC 30. If the head component is a photo-optical head component (FIG. 2), the data are transmitted to a sample and hold circuit 34. The sample and hold circuit 34 acts to delay the transmission of the analog signal from the head component to the A/D converter 36 until a maximum value output is detected. If the ionization head component (FIG. 3) or the heat sensor component (FIG. 4) are transmitting data, the data bypasses the sample and hold circuit 34 (by appropriate switching) and is directly transmitted to the A/D converter 36 as is discussed hereinafter.

The A/D converter 36 converts the analog signal from the head component to a digital signal which is ultimately processed by the control panel 12. The digital signal is transmitted to the control logic 32 of the communication control IC 30 for further processing. In addition, a calibration test can be performed on the A/D converter 36 by inputting a voltage from the 5 volt regulator at line 25 as is discussed hereinafter.

The control logic 32 receives data from the head component (via the A/D convertor 36) and transmits the data to the control panel 12 which determines the type of sensor and whether it is in an alarm condition. An alarm condition occurs when the sensor detects the presence of either smoke or heat depending upon the type of sensor installed in a base at the particular location. If an alarm condition is present, the control panel 12 instructs the control logic 32 to activate a power on/alarm trouble light emitting diode (LED) 38 to indicate to a local observer that an alarm condition exists at that particular location. The power on/alarm trouble LED 38 is preferably located on the face of the base component 10 or at some other observable position. It is to be understood by those skilled in the art that an audible signal as well as a visual LED can be triggered by the control logic 32 and by the control panel 12. In addition, the base component 10 has an address switch 40 which stores the identification of the location of the particular base component 10. The address switch 40 is operatively connected to the control logic 32. The address switch 40, is preferably a DIP switch which contains eight data bits. This allows 256 base locations to be identified. Address switch 40 is preset at a particular binary number which is transmitted to the base via the communication lines for identification of the location of each particular base component 10.

The control logic 32 of IC 30 transmits both the digital signal received from the A/D converter 36 (representing the data from the head component) as well as the identification binary number received from the address switch 40 to the transmit/receive circuit 15. The transmit/receive circuit 15 allows for transmission of the data to the control panel 12 via the communication lines 14, 14' for further processing and analysis. The data transmitted from the base component 10 to the control panel 12 is a value indicative of the voltage level generated by the sensor in the head component. The control panel 12 uses this information to determine the type of head component currently attached to the base component 10. Since each head component is active in a distinct voltage range which does not overlap with the voltage range of the other type of head components, the control panel can determine from the detected voltage level the type of head component which is attached to the particular base component 10 location. The control panel can also apply the appropriate algorithm to the voltage level within the range to determine if an alarm condition exists. Likewise, as will be described hereinafter, if the wrong head component is attached to the base component 10, the control panel 12 can apply the voltage signal to the proper algorithm to obtain an accurate reading for that particular head component. In addition, a calibration reading can be done to verify that the A/D converter 36 is functioning properly.

Referring specifically to FIG. 2, there is shown a schematic block diagram of a photo-optical type head component 42. The physical structure of the photo-optical head component 42 is conventional and may be Simplex Model 4098-9701. Head 42 includes three pin connections 18', 20', 22', which are complementary to the pins 18, 20, 22 of the base component 10. As discussed above, power is received from the 10.5 volt regulator 26 in the base component 10 at pin connection 22'. The 10.5 volt regulator is controlled by the control panel 12 which directs the control logic 32. Control logic 32 turns regulator 26 on or off via line 27. When regulator 26 is on, the 10.5 voltage is received in the head through a pair of diodes 44, 46 and a filter capacitor 48 which in part acts as a voltage regulator. Zener diode 50 conducts when the voltage received is 10.5 volts or greater. This causes a voltage to be present at voltage divider resistors 51, 53. Consequently, first NPN transistor 52 is held on, second NPN transistor 54 is held off and capacitor 48 is charged to 10.5 volts. The capacitor is preferably a 220 uF capacitor. In order for the base component 10 to receive a reading from the photo-optical head component 42, the voltage must be reduced below 5 volts.

When the base component 10 is instructed to obtain a reading from the photo-optical head component 42, the base component 10 through control logic 32 causes the 10.5 volt regulator 26 to lower the voltage supplied to the head component 42 below 5 volts for a predetermined amount of time, preferably 112 microseconds. The control panel 12 instructs the control logic 32 to turn the 10.5 volt regulator 26 off via line 27. The voltage supplied to the head component 42 is now supplied through pin 22 from the 5 volt regulator 28 of the base component 10. Thus, the voltage transmitted to the photo-optical head component 42 is lowered to below 10.5 volts. Once the voltage falls below 5 volts, the zener diode 50 stops conducting causing the first NPN transistor 52 to be turned off. When the first NPN transistor 52 turns off second NPN transistor 54 is turned on. Capacitor 48 begins to discharge through voltage divider resistors 57, 59 and transistor 54. The capacitor 48 provides a current source through resistors 57, 59 which triggers a light source control 58. The light source control 58 contains a first LED which is flashed. Photo diode 61 detects the light emitted by the first LED which is reflected from the chamber walls (not shown). This allows the photo-optical head component 42 to transmit an analog signal to the base component 10. A second LED on the face of the base component 10 flashes as the head component 42 is being sampled. This signals that the peripheral device is operative. In sum, the light source control 58, and particularly the first LED, is triggered when the voltage received by the head component is dropped and the capacitor 48 begins to discharge. Photo diode 60 will detect the light transmitted by the first LED and the resulting current transmitted by the photo diode 60 is amplified by an amplifier 62 and transmitted to the base component 10 via pin connection 20', 20. The value of this voltage within a particular range indicates the presence of a photo-optical head component.

If an alarm condition exists, smoke particles will have entered the head's control chamber (not shown) and cause scattering of the light emitted from the first LED. The particles will scatter the light from the LED 58 causing the reading from the photo diode 60 to be changed. If the reading from the photo diode 60 changes to a predetermined value, the analog signal received by the base component 10 via pins 20', 20, is transmitted to the control panel 12, and will cause the control logic 32 to activate the alarm and trouble LED 38.

It is significant to note that of the three types of head components which can be connected to the base component 10, only the photo-optical head component 42 draws a significant current. This is because the large capacitor 48 is required to supply a high current to the first LED for 112 microseconds. Once the IC 30 detects a voltage within the predetermined for a photo-optical detector range, the control panel 12 also informs the IC 30 that a photo-optical head component 42 is connected to that particular base component 10. Thus the data transmitted from the photo-optical head component 42 is used to determine the type of head component which is connected to the base component 10.

It is also important to note that since the capacitor 48 is relatively large, it takes a significant amount of time to charge and discharge. Therefore, the voltage data received by the base component 10 rises more slowly than is the case with an ionization sensor head component or a heat sensor head component. The A/D converter 36 alone, cannot adequately detect the peak signal from the photo-optical head component 42. Consequently, the data from the photo-optical head component 42 is first transmitted to the sample and hold circuit 34 as discussed above. The sample and hold circuit 34 holds the analog signal peak value of the photo-optical head component 42. Then the A/D converter 36 reads the signal.

Referring to FIG. 3, there is shown a schematic block diagram of an ionization sensor head component 64. The physical structure of head 64 may be a Simplex Time Recorder Model 4098-9716 head. As discussed above, the ionization sensor head component 64 comprises three pin connections 18'', 20'', and 22'' which are complementary to the pin connections 18, 20 and 22 of the base component 10. As in the case of the photo-optical head component 42, a voltage is received from the 10.5 volt regulator 26 of the base component 10 at pin connection 22''. This causes a zener diode 66 to conduct and holds a first NPN transistor 65 turned on. When the base component 10 wishes to obtain a type reading from the ionization head component 64, the voltage transmitted to the head component 64 is lowered by turning off the 10.5 volt regulator 26, as described above, but the 5 volt regulator 28 remains on. When the voltage falls below 5 V, the zener diode 66 stops conducting which causes transistor 65 to turn off because there no longer is a voltage across voltage divider resistors 61, 63. This causes a second NPN transistor 67 to turn on. This results in a current being transmitted through resistor 68.

Unlike the photo-optical head component 42, the ionization head component 64 is a low power device and does not draw a significant amount of current. It does not have a relatively large size capacitor. Ionization chamber 70 is a voltage sensitive device for determining the ambient conditions. The ionization sensor head component 64 primarily detects fires which release invisible particles into the air, for example, chemical fires. A change in the ionization in the air will change the voltage across the ion chamber 70.

The dc voltage from ion chamber 70 is within a distinct range and is a function of the presence or absence of small ionized particles within the chamber. This signal is amplified by amplifier 72 and transmitted to base 10 via pin 20'' and pin 20. Again, the value of the signal within a distinct range indicates the presence (or not) of an ionization type head detector. The particular value within the range indicates an alarm condition (or not).

Referring specifically to FIG. 4, there is shown a schematic block diagram of a heat sensor head component 74. The physical structure may be Simplex Time Recorder Model 4098-9731. The heat sensor head component 74 has three pin connections 18''', 20''', and 22''' which are complementary to the pin connections 18, 20, 22 of the base component 10. As with the ionization sensor head component 64, a 10.5 voltage is provided to the heat sensor head component 74 by the 10.5 volt regulator 26 via pin connection 22'''. The voltage is applied to a thermistor 76 and voltage divider 77, 79 which takes an analog reading of the control chamber (not shown). The voltage at the junction of resistors 77, 79 is a function of the heat sensed by the thermistor 76. The temperature in the control chamber is therefore sensed as a voltage within a predetermined range. The voltage is transmitted directly to the base via pins 20''', 20. The voltage is converted to a corresponding digital value by the A/D convertor 36 and sent to the control panel 12 by the control logic 32. As with the ionization sensor head component 64, the heat sensor head component 74 draws minimal current when the control chamber is being sampled. The value of the voltage within a distinct range indicates type and alarm status.

In accordance with the method of the present invention, the control panel 12 continuously monitors the peripheral device and commands the base component 10 to command the head component to test the ambient condition of the air in its control chamber and to send the resulting analog signal to the base component 10 for further processing. The base component converts the analog signals received from the head component to a digital signal for processing by the control panel 12. The control panel 12 evaluates the digital signal for type of head, alarm status, and service condition.

The control panel 1 commands the base component 10 to ascertain the type of head component currently installed at the particular location.

Continuous monitoring by the control panel 12 may be accomplished by regular and repeated peripheral fire detection polling of each peripheral device. It is preferred that the control panel 12 poll each peripheral device approximately once every four seconds, although one skilled in the art will appreciate that more or less frequent polling may be performed in accordance in the present invention. Polling methods suitable for use in the present invention are disclosed generally in U.S. Pat. No. 4,796,025, the specification of which is incorporated herein by reference.

Polling every four seconds is chosen to accommodate the time it takes to recharge capacitor 48 in the photo-optical sensor 42. More rapid polling of the ion sensor 64 or heat sensor 74 is possible because they use lower value capacitors, but four second polling is adequate for safety purposes.

The control panel 12 also regularly performs a calibration poll to verify that the A/D converter 36 is functioning properly. The control logic 32 in the base component 10, when reading the output for 5 volt regulator 28 at the junction of resistor 90 and diode 91 will compare the current reading to a previous one stored in the communication control IC 30. If the two readings are not within a designated range contained within the communication control IC 30, this is an indication that the A/D converter 36 is malfunctioning.

Figure 5A:
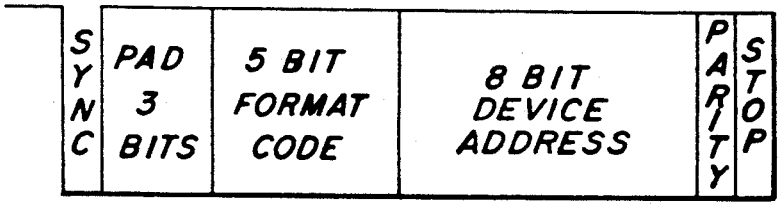
FIG. 5*a* is a schematic illustration of a data stream sent by the control panel to a base component.

Polling begins with a first message sent by the control panel 12 requesting whether there has been a change in the status of the peripheral detection device. In one presently preferred embodiment, illustrated by the detailed schematic of FIG. 5*a*, the first digital message comprises a digital data stream which preferably includes a sync bit to indicate the beginning of the message; three bits for providing time for the communication interface to recharge because the sync bit causes a substantial drop in the voltage across the communication lines 14, 14'. Specifically, the sync bit is a negative pulse going between 36 VDC and 0 VDC. The first message also includes a five-bit format code indicating the amount of data to be sent by the control panel 12 and containing the current status request message; an eight-bit address indicating the location of the base component 10 to be polled; a parity bit; and a stop bit for a total of 19 bits. The base address is stored in address switch 40. In this manner the control panel 12 addresses a particular base component 10. A significant feature of this invention is the fact that the address can be stored in the base. One skilled in the art will appreciate that other data stream formats may be used in accordance with the present invention depending on the capacity of the communications hardware and software, as well as other programming and system factors.

When the head component is removed from the base component 10, the control logic 32 is held reset. The base component 10 includes interlock or contact 23. When the head component is removed from the base component 10, the contact 23 is physically disconnected from the control logic 32. When the contact 23 is disconnected from the control logic 32, the control logic 32 notifies the control panel 12 of the disconnect status at this particular address. While there is no head component installed, the control logic 32 continues to be held reset in the base component 10 and cannot respond to any poll or command sent by the control panel 12. Thus, the control panel is signaled of the absence of a head component. When a head component is installed at the base component 10, the control logic reset is removed because the contact 23 is connected by the placement of a head component in the base component 10. Once this occurs, the new head component is powered and the base component 10 resumes full communications with the control panel 12. Once the reset is removed, the base component 10 responds to the next poll with a message indicating there has been a change in status. The message indicating a change in status will indicate that control logic 32 has lost the information indicating what type of head component is currently installed at the base component.

If there has been no change in the status of the peripheral device, the base component 10 responds with a second message indicating there has not been a change in the status of the peripheral device. But if the head component is removed from the peripheral device, or is replaced with the same or a different head component, the base component 10 responds to the poll with a second message that allows the control panel 12 to initiate a sequence of messages which, as will be presently understood, allows the control panel 12 to adjust to a different type of head components without a loss in protection.

Figure 5B:
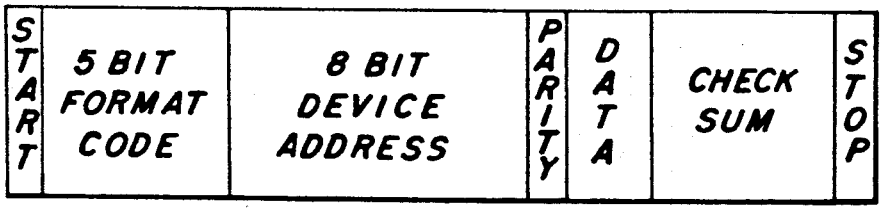
FIG. 5*b* is a schematic illustration of a data stream sent by the base component to the remote control panel.

The presently preferred embodiment of the second message indicating a change in status is illustrated in FIG. 5*b*. The second digital message is data stream which preferably includes a start bit to indicate the beginning of the message, a five-bit format field which indicates a two-bit data field is to be sent, an eight-bit address indicating the location of the base component, a parity bit, a two-bit data field to indicate that the base component 10 has lost the type code of the head component currently installed at the base component 10, a five-bit check sum to signal if there has been any error in the transmission, and a stop bit for a total of 23 bits.

Figure 5C:
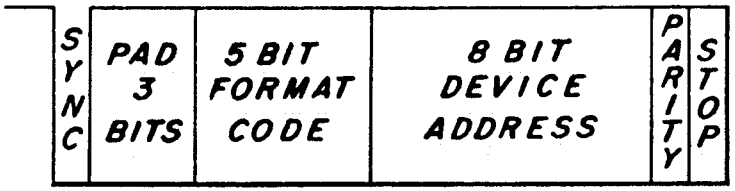
FIG. 5*c* a schematic illustration of a data stream sent by the control panel to the base component.

Upon receiving the second digital message from the base component 10, the control panel sends a third digital message FIG. 5*c* and as previously indicated, upon receiving this third digital message, the base component drops the power supplied to the head component to under 5 volts. Since each type of head component is different, dropping the voltage supplied to it causes different internal results. Thus, each type of head component will produce a unique voltage corresponding to the type of head component currently installed. This voltage is identified by the base component and the control panel.

The control panel sends the third digital message or device inquire poll shown in FIG. 5*c* to the base component to determine what type of head component is currently installed at the base component 10. Referring to the schematic of FIG. 5*c*, the third digital message preferably includes a sync bit to indicate the beginning of the message, three bits to give the communication interface time to recharge, a five-bit format code which includes the device inquire message, an eight-bit address identifying the location of the base component 10, a parity bit, and a stop bit for a total of 17 bits.

Once the base component 10 receives the third digital message, the control logic 32 drops the power supplied to the head component in the manner previously explained. Each type of head component has a different circuit to produce unique voltage values which are then read by the base component 10. The analog and digital value of the voltage signal indicating the type of head component currently installed at the base component 10 are shown in Table 1.

TABLE I

| Type | Analog Value | Digital Value |
|---|---|---|
| Heat | 4.94 VMAX | 252 |
| | 4.00 VMIN | 204 |
| Photo-optical | 3.92 VMAX | 200 |
| | 2.90 VMIN | 148 |
| Ionization | 2.66 VMAX | 136 |
| | 1.80 VMIN | 92 |

The different values shown in Table correspond to the different types of head components and are converted from the analog values to the digital values by the A/D converter 36 for transmission to the control panel 12 in a fourth digital message.

Figure 5D:
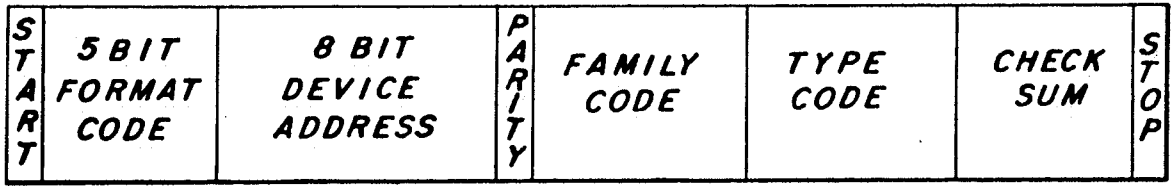
FIG. 5*d* is a schematic illustration of a data stream sent by the base component to the control panel.

Referring to the schematic of FIG. 5*d*, the fourth digital message 108 includes a start bit to indicate the beginning of the message, a five-bit format code indicating the amount of data to be sent by the base component 10, an eight-bit address indicating the location of the base component 10, a parity bit, a six-bit family code indicating an analog sensor is used in the head component, a 6 bit type code indicating the specific type of head component, a five-bit check sum field to signal any error in data transfer, and stop bit for a total of 33 bits.

Figure 5E:
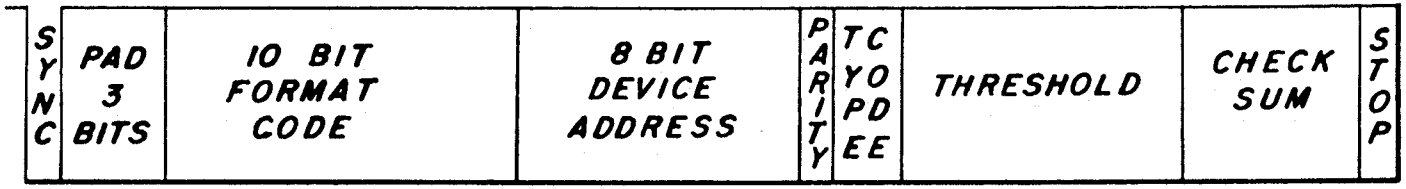
FIG. 5*e* is a schematic illustration of a data stream sent by the control panel to the base component.

After receiving the fourth digital message from the base component 10, the control panel 12 sends a fifth digital message informing the base component 10 what type of head component is currently installed at the base component 10. FIG. 5*e* is a schematic illustration of the fifth digital message, which preferably comprises a sync bit to indicate the beginning of the message, three delay bits, a five-bit format code indicating the amount of data to be sent to the base component 10, an eight-bit address indicating the location of the base component 10, a parity bit, a two-bit type code indicating the type of head component currently installed at the base component 10, an eight-bit threshold message which is used by the base component 10 to determine if a pre-alarm threshold is exceeded by comparing it to the analog reading, a five-bit check sum field to signal any error in data transfer, and a stop bit for a total of 34 bits.

The two-bit type code of the fifth digital message 120 sent to the control panel 12, and is also compared by the control panel 12 to the type of head component that is contained within the control panel's memory. If a mismatch is found, the control panel preferably initiates a trouble "wrong device installed" message to a human operator by either a visual and/or audible message. When such a message is initiated it is desirable to have the message indicated by the control panel 12 until a human operator determines whether the head component installed in the base component 10 is or is not the type actually desired at that particular location. Once a determination is made, the head component may be changed or the memory of the control panel 12 may be reprogrammed to reflect the type of head component currently installed at the base component 10. Regardless, the control panel 12 will adjust the algorithm within its memory to correspond to the type of head component currently installed in the base component 10 so that any evaluation of the ambient air in the head component is appropriate to the actual head type.

Figure 6:
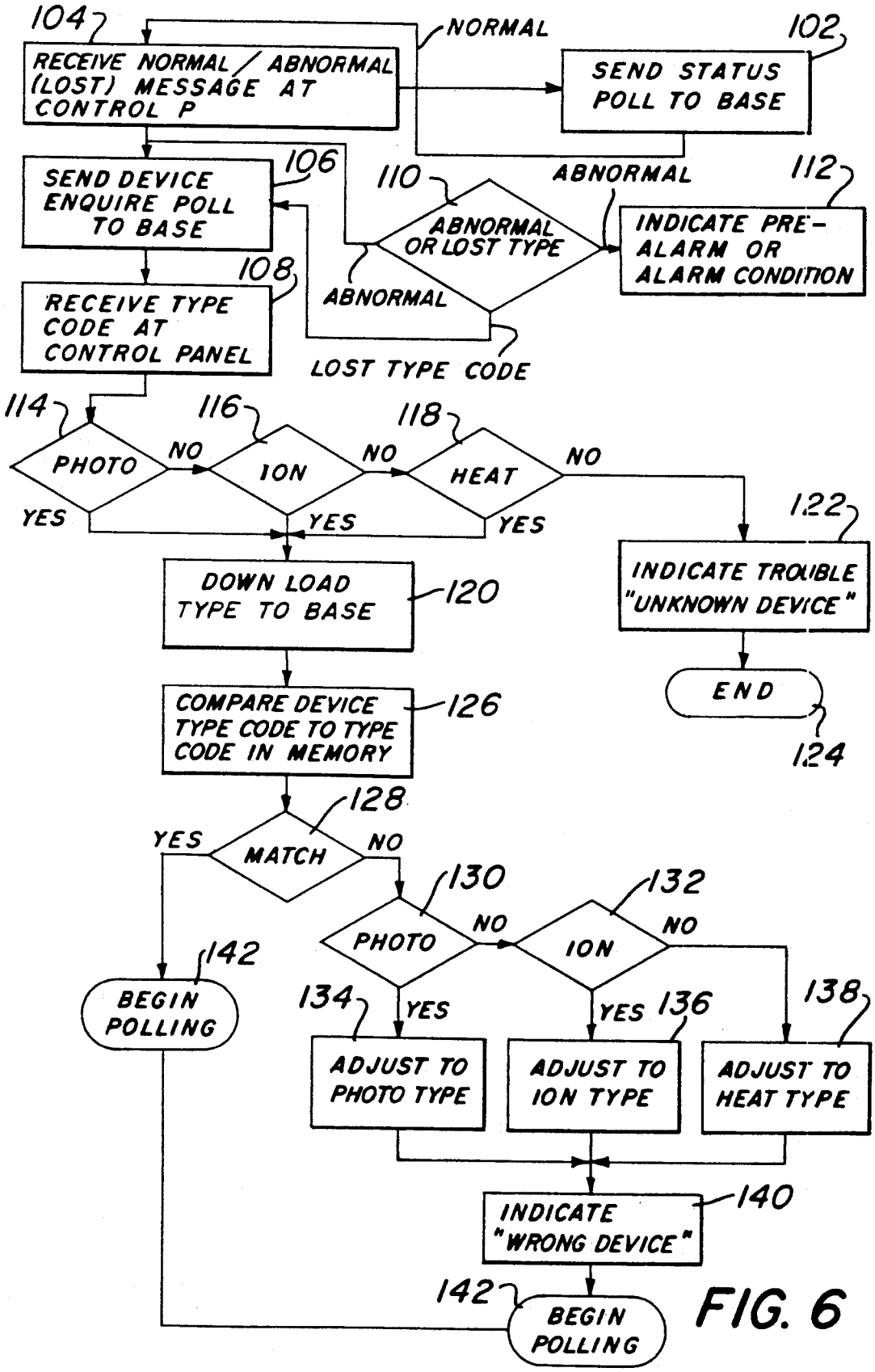
FIG. 6 is flowchart illustrating the process of the present invention.

FIG. 6 illustrates the sequence taken by control panel to adjust to different types of head components. Thus, when the control panel 12 receives a message from a newly activated peripheral fire detection device, it initiates a polling sequence to determine what type of head component is installed at the base component 10, and if necessary, adjusts the algorithm or values inserted into an algorithm to correspond to the type of head component currently installed at the base component 10. The sequence begins upon the installation of the head component because only then is the reset removed.

In practice, for example, if a photo-optical type of head component were removed and a heat sensor type of head component installed in its place, the control panel 12 will indicate a wrong device is installed and change the algorithm or the values used in the algorithm from a photo-optical specific algorithm to one specific to heat sensors.

Referring to FIG. 6, the control panel 12 monitors each peripheral device with a series of status polls. See FIG. 5A–E . If, as in the previous example, a photo-optical type head component was at a particular location, the control panel monitors the peripheral device with a series of status polls 102. If the type of peripheral device is unchanged, the device answers the status poll 102 with a normal message (normal path 104 to 102). If the photo-optical head component has been removed and a heat sensor type of head component is, for example, installed in its place, the base component will answer the status poll 102 with an abnormal message. The abnormal message indicates either the head component does not know what type of head component is installed, or that an alarm condition may exist. Upon receiving an abnormal message 104, the control panel 12 determines (110) if it is an abnormal message indicating the threshold is exceeded or a message indicating the type of head component is unknown. An abnormal message indicates to the control panel that the status of the peripheral device has changed. If the control panel determines the threshold is exceeded (abnormal path of 110), the control panel indicates that a pre-alarm or alarm condition 112 is present at the peripheral device. If the control panel determines the type of head component is unknown (lost type code path of 110), it will inquire of the base component as to what kind of head component is currently installed by sending a message 106. The memory of the control panel will indicate a photo-optical type head component is installed until it is instructed otherwise. In response to the message 106, the peripheral device answers with a message 108 informing the control panel what type of head component is installed. The control panel takes the information received in the message 108 and compares it to the information contained within the control panel to determine the type until a match is attained (114, 116, 118). If a heat sensor type head component was installed, the control panel sends another message 120 to the base component in the peripheral device identifying the actual type of head component installed at the peripheral device. If the control panel cannot identify the type of head component installed, it indicates 122 that there is an unknown device at the peripheral device.

Once the control panel is informed of the peripheral device type, it must make certain it is applying the correct algorithm or values used in the algorithm to process data received from the head component currently at the peripheral device. Because each type of head component produces different voltage outputs, the control panel must apply the correct algorithm or values to the data output by the peripheral device. Therefore, the information pertaining to the type of head component currently located at the peripheral device must correspond to the information contained within the control panel memory to make sure the correct algorithm or values are being applied. If there is a match (yes path of 128), the control panel resumes regular polling 142 for it is certain the correct algorithm or values are being applied. If there is not a match (no path of 128), the control panel then performs a comparison to ascertain which algorithm or values should be used. In the present example, the control panel first checks to see if the head component installed is a photo-optical type 130. If it is, the control panel adjusts the algorithm or values to conform to those required or a photo-optical type. If not, the control panel performs the same step to see if a match is found for an ion detector. If no match is found, then a heat type detector is assumed. Thus, the control panel adjusts its algorithm values (134, 136, 138) to correspond to the head component actually installed in the base component. Once it is determined which type of algorithm values should be applied, the control panel provides an indication to a human operator that the head component currently at the peripheral device is not the type the control panel previously had determined was there. This enables an operator to determine whether the type of head component is appropriate for the particular location without a stoppage in the operation of the alarm system. Thus, when a defective or dirty head component is removed from a location, and a different, and possibly wrong, type of head component is installed, an operator or service technician can recognize this fact. Also protection continues and is maximized.

The present invention may be embodied in other specific firms without departing from the spirit or essential attributes thereof and, accordingly reference should be made to the appended claims, rather than the specification, as indicating the scope of the invention.

We claim:

1. An alarm apparatus for multiplexing alarm and type values in a peripheral fire detection device in communication with a control panel comprising:

a head component comprising means of a particular type for sensing on command the presence or absence of an alarm condition and generating values representative of both an alarm condition and type of sensor;

a base component for securing the head component in position, said base component comprising means for communicating with the control panel and controlling the head component according to commands received from the control panel; and a communication interface for multiplexing alarm and type values between the head component and the base component comprising no more than three connectors electrically coupled to the head component and the base component.

2. The alarm apparatus as recited in claim 1, wherein the communication interface between the base component and the head component includes means for providing power to the head component from the base component.

3. The alarm apparatus as recited in claim 1, wherein the means for storing the address of the peripheral fire detection device is located in the base.

4. The alarm apparatus as recited in claim 1, wherein the first connector is a power plus connection; the second connector is a power common connection; the third connector is an analog value output connection.

5. A method for communicating in an alarm detection system between a central control panel and at least one alarm condition detection device comprising a base component and a separable head component, the method comprising:

(a) storing the address of the fire detection device in the base;

(b) commanding the head component from the control panel to output data to the base component indicating the type of head component sensor currently installed in the base component;

(c) outputting analog data from the head component to the base component representative of both an alarm condition and type of head component currently installed at the base component; and (d) transmitting the data from the base component to the control panel, and processing the data received from the base component to determine type and alarm condition.

6. A method for continuously adjusting an alarm detection system having a control panel and at least one alarm detection device comprising a base component and head component, wherein the head component may be one of several types of alarm condition sensors which may be interchangeably installed in the base component, wherein the control panel includes a unique predetermined algorithm for each type of head component for determining if an alarm condition exists according to data received from the alarm detection device, and wherein the base component is addressable, comprising the steps of:

(a) sending a first digital message from the control panel to the base component requesting the current status of the head component;

(b) receiving at the control panel a second digital message from the base component which indicates a normal or abnormal status of the head component;

(c) sending a third digital message from the control panel to the base component instructing the base component to indicate the type of head component when an abnormal status is indicated by the second digital message;

(d) receiving at the control panel a fourth digital message from the base component which indicates the type of head component;

(e) sending a fifth digital from the control panel to the base component identifying to the base component the type of head component;

(f) comparing the head type information sent to the base component with the fifth digital message to a set of algorithms corresponding to the types of head components; and (g) selecting an algorithm corresponding to the type of head component identified in the fifth digital message.

7. A method as recited in claim 6, wherein the head component is selected from the group consisting of ionization, photo-optical and heat sensors.

8. A method as recited in claim 6, wherein if the second digital message received from the base component indicates an abnormal status of the head component, the control panel determines if said abnormal message indicates an alarm condition or is a message indicating that the information pertaining to the type of head component is missing.

9. A method as recited in claim 6, wherein selecting a predetermined algorithm or corresponding to the type of head component further includes the step of:

(h) indicating to a human operator by indicating means that an incorrect head component may be present at the peripheral detection device.

10. A method as recited in claim 6, wherein if there is no a head component present at the peripheral detection device the base component will not respond to messages sent by the control panel.

* * * * *